US008991881B2

(12) United States Patent
Shilts

(10) Patent No.: US 8,991,881 B2
(45) **Date of Patent: *Mar. 31, 2015**

(54) ANTI-LIGATIVE DOORKNOB

(71) Applicant: Assa Abloy, Inc., New Haven, CT (US)

(72) Inventor: Steven J. Shilts, San Diego, CA (US)

(73) Assignee: Assa Abloy, Inc., New Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/269,311

(22) Filed: May 5, 2014

(65) Prior Publication Data

US 2014/0239651 A1 Aug. 28, 2014

Related U.S. Application Data

(60) Continuation of application No. 13/775,231, filed on Feb. 24, 2013, now Pat. No. 8,777,282, which is a division of application No. 12/657,594, filed on Jan. 25, 2010, now Pat. No. 8,430,436.

(51) Int. Cl.
*E05B 1/00* (2006.01)
*E05B 15/10* (2006.01)
(Continued)

(52) U.S. Cl.
CPC ..... *E05B 1/0007* (2013.01); *E05B 1/003* (2013.01); *E05B 15/10* (2013.01); *E05B 65/0017* (2013.01); *Y10S 292/65* (2013.01)
USPC ..... 292/347; 292/92; 292/DIG. 65

(58) Field of Classification Search
CPC ..... E05B 85/12; E05B 85/16; E05B 85/10
USPC ..... 292/336.3
See application file for complete search history.

(56) References Cited

U.S. PATENT DOCUMENTS 266,947 A * 10/1882 Zerfas ..... 70/150
469,863 A * 3/1892 Marks ..... 292/92
609,422 A * 8/1898 Fackner ..... 292/73
(Continued)

FOREIGN PATENT DOCUMENTS

BE 1008810 8/1996
DE 10053062 5/2002
(Continued)

*Primary Examiner* — Carlos Lugo
(74) *Attorney, Agent, or Firm* — DeLio, Peterson & Curcio, LLC

(57) ABSTRACT

An anti-ligative ergonomic type door-knob primarily of the institutional type, essentially serving to defeat the effort of a temporarily mentally-depressed room occupant from succeeding in committing self-hanging via contrived ensnaring by which to secure a cord like hanging-noose. Generic-variant embodiments of my anti-ligative doorknob are set forth, including both a circular and semi-circular escutcheon-plate for I-shaped V-shaped Y-shaped X-shaped fin-levers, and also a non-finned hemispherical iteration. The novel critical minimum approximate 40-degree anti-ligative principle of my LIFESTAR™ doorknobs reliably prevents a person ensnaring any heretofore problematically hazardous to portion of the door-knob assembly, while my optionally cooperating door latchbolt is formed to a matching critical minimum approximate 40-degree anti-ligative tri-beveled latchbolt as well. Further suicide-deterrence is achieved by effectively submerging the doorknob into the door escutcheon-plate, thereby leaving virtually no declivity by which a suicidal-person can secure any manner of self-inflicted hanging-cord.

23 Claims, 7 Drawing Sheets

(51) Int. Cl.
*E05B 65/00* (2006.01)
*E05B 65/10* (2006.01)

(56) References Cited

U.S. PATENT DOCUMENTS

| | | | | | |
|---|---|---|---|---|---|
| 975,037 | A | * | 11/1910 | Hettwer | 292/126 |
| 1,326,450 | A | * | 12/1919 | Howard et al. | 49/460 |
| 1,434,370 | A | * | 11/1922 | Crompton et al. | 292/163 |
| 1,738,387 | A | * | 12/1929 | Niessen et al. | 292/74 |
| D114,315 | S | * | 4/1939 | Brodbeck | D8/311 |
| 2,304,145 | A | * | 12/1942 | Borchers | 292/336.3 |
| 2,321,724 | A | * | 6/1943 | Aldeen et al. | 292/336.3 |
| D145,210 | S | * | 7/1946 | Fisk | D8/312 |
| 2,581,606 | A | * | 1/1952 | Seaman et al. | 292/74 |
| 2,755,120 | A | * | 7/1956 | Young et al. | 292/74 |
| 2,813,737 | A | * | 11/1957 | Reiter | 292/74 |
| 3,038,757 | A | | 6/1962 | Schulze | |
| 3,713,683 | A | | 1/1973 | Neary | |
| 3,792,887 | A | * | 2/1974 | Ramsey | 292/169.21 |
| 4,064,721 | A | | 12/1977 | Morgan | |
| D267,194 | S | * | 12/1982 | Baker | D23/386 |
| 4,404,709 | A | * | 9/1983 | Janz et al. | 16/444 |
| 4,492,394 | A | | 1/1985 | Dignan | |
| 4,575,141 | A | | 3/1986 | Burns | |
| 5,303,965 | A | * | 4/1994 | Meehan | 292/336.3 |
| 5,797,286 | A | * | 8/1998 | Armstrong | 70/224 |
| 5,918,916 | A | * | 7/1999 | Kajuch | 292/163 |
| 6,135,512 | A | * | 10/2000 | Galvin | 292/163 |
| 6,460,906 | B2 | | 10/2002 | Bingle et al. | |
| 7,373,694 | B1 | | 5/2008 | Kopp | |
| 7,617,707 | B2 | | 11/2009 | Chiang | |
| 7,802,828 | B2 | | 9/2010 | Hopkins et al. | |
| 8,052,182 | B1 | | 11/2011 | Weinerman et al. | |
| 8,122,745 | B2 | | 2/2012 | Ramsauer et al. | |
| 2003/0135956 | A1 | * | 7/2003 | Gunthardt | 16/430 |
| 2003/0150247 | A1 | * | 8/2003 | Talpe | 70/210 |
| 2006/0220398 | A1 | * | 10/2006 | Ruano et al. | 292/347 |
| 2010/0013248 | A1 | * | 1/2010 | Keller | 292/347 |
| 2010/0072762 | A1 | * | 3/2010 | Marks | 292/336.3 |
| 2010/0126239 | A1 | * | 5/2010 | Berger | 70/92 |
| 2010/0327611 | A1 | | 12/2010 | Rees | |
| 2011/0068927 | A1 | | 3/2011 | Berger | |
| 2011/0120024 | A1 | | 5/2011 | Shilts | |
| 2011/0174026 | A1 | * | 7/2011 | Salvatore et al. | 70/91 |

FOREIGN PATENT DOCUMENTS

| | | | |
|---|---|---|---|
| EP | 1927709 | | 6/2008 |
| GB | 2276659 | | 10/1994 |
| GB | 2413068 | | 10/2005 |
| GB | 2459884 | | 11/2009 |
| JP | 1970021044 | | 8/1970 |
| JP | 000492398 | | 1/1979 |
| JP | 05240972 | A | 9/1993 |
| JP | 000895580 | | 4/1994 |
| JP | 2004162401 | | 6/2004 |
| JP | 2004324250 | | 11/2004 |
| JP | 0003137332 | | 10/2007 |
| WO | WO 2010092398 | | 8/2010 |

* cited by examiner

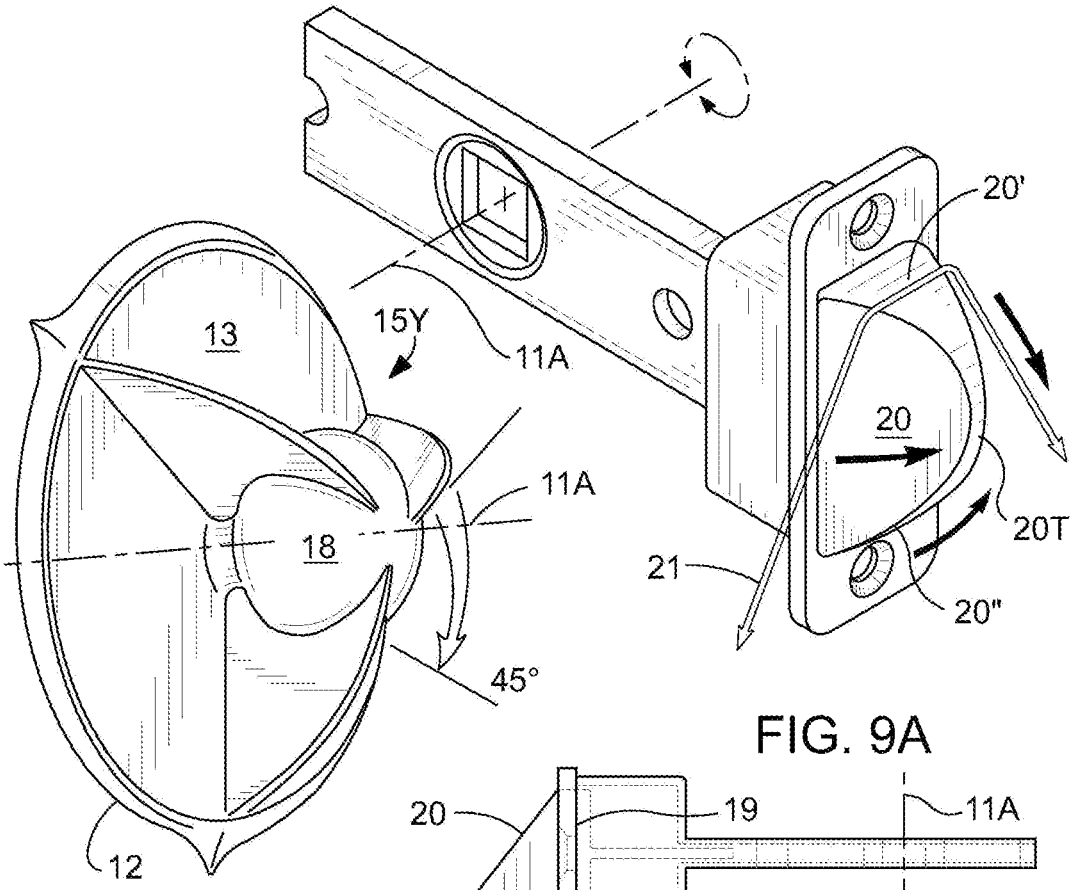
FIG. 5
FIG. 9A
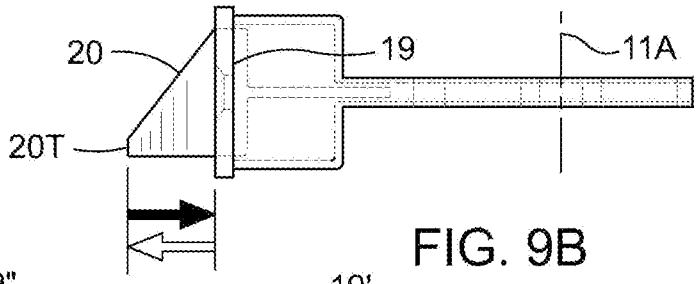
FIG. 9B
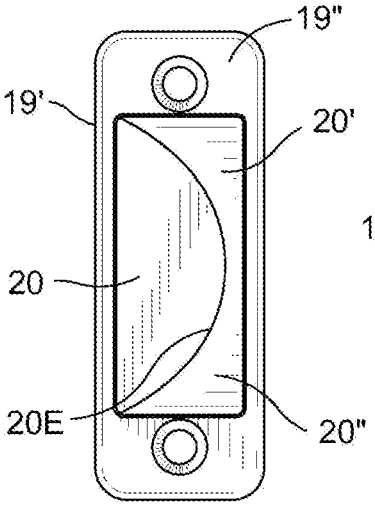
FIG. 9C
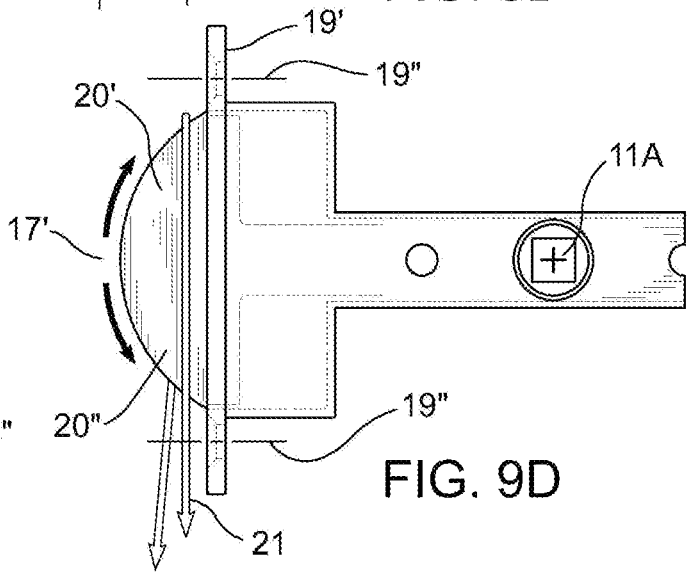
FIG. 9D

ANTI-LIGATIVE DOORKNOB

PRIORITY OF DISCLOSURE

This invention disclosure is preceded by U.S. provisional patent application No. 61/001,210 filed Oct. 31, 2007. This application is a continuation of pending U.S. patent application Ser. No. 13/775,231 filed on Feb. 24, 2013, which is a divisional of U.S. patent application Ser. No. 12/657,594 filed on Jan. 25, 2010, issued as U.S. Pat. No. 8,430,436, which claims priority from U.S. provisional patent application No. 61/159,444 filed on Mar. 12, 2009 and U.S. provisional patent application No. 61/206,228 filed on Jan. 29, 2009.

GOVERNMENT RESERVATION STATEMENT

This work was supported by the U.S. Department of Veterans Affairs, and the Federal Government has certain rights in this invention.

I. BACKGROUND OF THE INVENTION

1. Field of the Invention

This invention relates to rotary-actuators in the form of door-knobs, and more specifically it relates to doorknobs and associated latches for hinged-doors employing anti-ligative ensnaring resistant means, hence particularly suited to institutional usage (i.e. psychiatric-institutions, hospitals, jails, etc.)—as an impulsive-suicide deterrent.

2. Relevant Prior Art

Presently there are several door-lock companies producing what they elude to as anti-ligative suicide deterrent doorknobs, nevertheless successful attempts continue to be achieved via these hardware owing their for one reason or another still not achieving true non-ensnarable construction. For example, some firms produce door-knobs which while perhaps designed free of ensnarable declivities, such as eliminating the traditional bulbuls grasping-knob,—yet employ to shallow a pitch or slope of the doorknob,—thereby unwittingly enabling a person to snag a loop of cord there around, and ultimately obtain some manner of cross-lashing to the opposite like designed door-knob for example. Still other manufacturers make L-shaped door-knobs claimed to be anti-ligative, which are nevertheless predictably ensnarable no matter how slick their design,—merely by means of cross-lashing. However, I have discovered and make full disclosure herein, of a critical transition-point technique of construction to which no cording can be successfully secured;—this vitally critical slope or pitch angle being an approximate minimum of 40-degrees (—as measured relative to the doorknob's central-axis of rotation).

Background research discovery provided relatively little prior patent-art regarded as germane to this disclosure, chronologically for example U.S. Pat. No. 3,792,877 (filed: June 1972) shows a latch-bolt member (102) of cylindrical design, which poses a typical problem with regard to the nature of its horizontal slide-surface providing a potential ensnaring point where a small cord such as a shoelace or electrical-cord could be lodged in an ensnaring manner by a mentally-depressed person impulsively intent upon terminating themself via a contrived hanging-noose means.

In U.S. Patent Application Publication No. 2003/0135956 (filed: January 2003) is shown an ergonomic "ErgoHandle," which exhibits a novel snare preventative configuration,—however it is entirely remiss of any positive-acting latching and release means;—therefore as such, it is essentially limited for usage in conjunction with cabinet-doors and drawers and the like.

In U.S. Patent Application Publication No. 2006/0220398 (filed: March 2006) shows an doorknob which in its FIGS. 1 & 2 embodiment is substantially free of surface undulations such as a reduced neck-diameter which would enable a person to snag a cord like entity such as a shoelace; —however, the joint-crevice created where the doorknob (1) merges with the decorative-ring (2), along with the overall shape of the doorknob projecting at a right-angle from the door-surface, in of itself constitutes a convenient ensnarable protrusion. Accordingly, while ergonomic in design relative to the inventor's desire to provide a doorknob offering improved rotational grasping ability, the substantially cylindrical shape still poses the inherent problem of ensnarability residing in all conventional doorknobs.

Additionally, there is a less germane class of utility-knobs such as have been designed for gas-burner valve-controls for kitchen-stoves, and radio control-knobs, such as are generally exemplified in U.S. Pat. No. D114,315 (filed: October 1938) showing a 3-finned knob, No. D145,210 (filed: November 1945) showing a 4-finned knob, and No. D267,194 (filed: January 1980) showing a 6-finned;—however, none of the designs anticipated an anti-ligative purpose, whilst all of the designs employed shapes which characterized exactly the problem which my invention serves to overcome, whereby each of them would allow a cord to be lodged transversely across their finger-hold fins without sliding off;—while also posing the potential to secure a cord of some sort behind the base of the knob.

Therefore, in full consideration of the preceding patent review, there is revealed a need for an improved form of hardware to which these identified prior-art inventions have been at least remotely addressed. The inventor hereof believes their newly improved door-knob device, referred commercially to as the LIFESTAR™ doorknob, being developed for production under auspices of Shilts-Mfg./Mkt. Co., exhibits certain unique human-factors design advantages, as shall become clearly revealed in the subsequent portion of this disclosure.

II. SUMMARY OF THE INVENTION

A.) In view of the foregoing discussion about the earlier invention art, it is therefore important to make it pellucid to others interested in the art that the object of my invention is to provide a doorknob having a vital anti-ligative safety oriented configuration, serving to prevent a temporarily suicidal person from hanging themself via the usual resourcefulness of resorting to use of a hangman's-noose contrived from any available sort of cording such as a fabric-sheeting, carpet-thread, or shoelace(s) by which to ensnare, as is the problem with a conventionally protruding door-knob. Thus, in place of the typical protruding rotary door-knob, my safety doorknob preferably features one or more unique radial-fin elements, which may for example be adapted into a tri-finned embodiment, wherein the radially tapering fins in effect serve not only to deflect attempt at ensnarement, but also as flush-fitting low-profile hand-levers;—critically presenting no minute declivity in the form of a radial-ledge or hole by which an institutionally confined mentally-deranged, perhaps drug-induced person, can engage even material as seemingly innocuous as dental-floss. So as to defeat any ensnaring ligation (—hence, technically referred to as 'anti-ligative'), the non-ensnarable fin-levers are generally ergonomically formed integrally with a cooperative backing-plate portion, while extending radially outward supported upon a conventional door-knob rotary-shank axis, the fin-levers outer-terminuses ultimately tapering smoothly inboard as to merge into the perimeter surface of the co-rotating backing-plate; thereby obviating any manner of ensnarable declivity. If desired, a quasi-knob of sorts can still be provided centrally, in so long as no portion of such provisional grasping-knob is exposed in a manner which would provide an ensnarable surface exceeding an approximate 40-degree slope relative to the door-knob's axis of rotation; or alternatively, my radially finned doorknob may function entirely without any form of central knob entity if preferred;—and can be made of cast or stamped metal, or of a durable engineered organic material such as glass-impregnated polycarbonate-plastic.

B.) Another object of this invention disclosure is to set forth an anti-ligative type doorknob according to preceding item—A, wherein my LIFESTAR™ doorknob also ergonomically facilitates usage by a handicapped handless person, by virtue of their engaging the stub-wrist portion of their forearm with one of the optional fin-lever pull-pockets formed by the convergence of the optional central-knob recess. This handicapped function maybe achieved by simultaneous action of both stub-wrists,—one engaging the central knob-pocket region so as to 'pull', while the other stub-wrist engages one of the knob-fins so as to apply a rotary-action;—or, if the handicapped person has but a single handless arm, they may nevertheless engage their stub-wrist into the pull-pocket region, while applying a rotary-action via their forearm upon one of the knob-fins so as to thereby readily operate a LIFESTAR™ equipped door. With my preferred Y-shaped doorknob embodiment, a non-handicapped person finds grasping of the centrally integrated optional knob portion forming the three pull-pockets is also quite ergonomically facilitating, and has been found to be as easily operated as a conventional door-knob. Moreover, my preferably 'finned' doorknob can actually function with just a single transverse fin-lever. or two divergent fin-levers arranged in either a horizontally-opposed manner or arranged in a V-shaped configuration;—noting that a fin-lever plurality of more than five radiating from the center-axis becomes rather excessive from a human-factors ergonomic engineering standpoint. Also, it is to be understood that my disclosure includes a doorknob embodiment entirely devoid of radial-fin elements, which is described as an equivalent anti-ligative surface tantamount to a hemisphere having two or more dimple like dished finger-hold means by which to achieve requisite grasping and rotation of the existing conventional door-knob shaft. In any case the surrounding cooperative fixed escutcheon-plate with its necessarily circular enshrouding annular-recess, may be formed outwardly therefrom to most any outlaying form of plain or fancy ornamental design (i.e. circular, square, curvilinear, etc.), in so long as it not hinder the vital notion of anti-ligative function being set forth herein. Moreover, my anti-ligative LIFESTAR™ doorknob may be employed on both sides, or upon only side of a door, dependent entirely upon institutional requirements; as not all institutional doors require anti-ligative hardware be provided upon both sides of a door. For example, a patient under general observation, may be allowed to leave their room and wander about an institution ward-section, perhaps to watch TV in a Dayroom, whereby there is thus a need to have an anti-ligative doorknob installed only upon the patient accessible hallway side of a normally locked Store-room door (—and with the door being locked, there is thus no need for installation of an anti-ligative latchbolt either).

C.) Another object of this invention disclosure is to set forth an anti-ligative type doorknob according to preceding items—A/B, wherein a substantially conventional rotary-shank may be employed, whereby as a significant cost-saving advantage in converting existing conventional doorknobs, my stage-I star-finned LIFESTAR™ doorknob conversion may be optionally retrofittable to an existing heavy-duty quality institutional doorlock assembly. However, because there are cases, when an institutionalized depressed person may resort to extreme measures in order to desperately terminate themself, my Stage-II LIFESTAR™ doorknob embodiment serves to replace the entire doorlock assembly (either tubular-mortise or vertical rectangular-slotted heavy-duty type mortise), as to thereby include my cooperative tri-bevel door latchbolt member within an otherwise conventional doorlock mechanism, thus serving to eliminate further potential ensnaring points;—thereby defeating attempts at capturing the spring-biased door latchbolt itself, hence providing total deterrence against suicide relative to ensnarement of either the doorknob or its cooperative horizontally-translating sliding latchbolt member.

D.) Another object of this invention disclosure is to provide an anti-ligative type doorknob according to preceding items—A/B/C, wherein is also set forth a universal "method" of negating suicide via anti-ligative door hardware preferably employing one or both critical minimum approximate 40-degree anti-ligative fin-levered doorknobs. My universal method comprising the steps of first providing a new blank-door requiring installation of a through-hole for passage of a door rotary-shank (generally centered anywhere from 2⅜ to 6" inboard from outer distal edge of door, opposite the hinged-end of the door), and installation of a suitable mortising-hole (i.e. either circular or slotted as deemed appropriate) for a lock-mechanism. Or alternatively, re-using of an existing door, by removing problematical conventional door-knob hardware from a first-side and optionally from the opposite second-side of the door, including supporting bezel-rings (which may have a problematical radial-ledge like ensnaring surface, and including optional removal of the conventional door-latch mechanism having an ensnarable latchbolt. Next, proceed with installation of my critical minimum 40-degree anti-ligative hardware at all places where the conventional door hardware has been vacated as deemed to be posing a ligation hazard, including escutcheon-plates featuring my critical minimum 40-degree anti-ligative annular-recess, and my LIFESTAR™ doorknobs featuring critical minimum approximate 40-degree anti-ligation configuration onto protruding rotary-shanks until the circular backing-plate portion of the doorknob(s) is/are snugly seated in a slip-fitting manner into its respective annular-recess, and all fasteners are secured. Therefore, with this universal methodology, one can selectively determine a cost-effective configuration of a door, achieving the optimal installation of critical minimum approximate 40-degree anti-ligative door hardware upon either just a first-side or including a second-side of a new or re-used door, along with the option of including my anti-ligative latchbolt;—in a manner which is most cost-effective for the institutions various door emplacements, and their desire to negate this present costly potential institutional liability.

III. DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

Figure 3A:
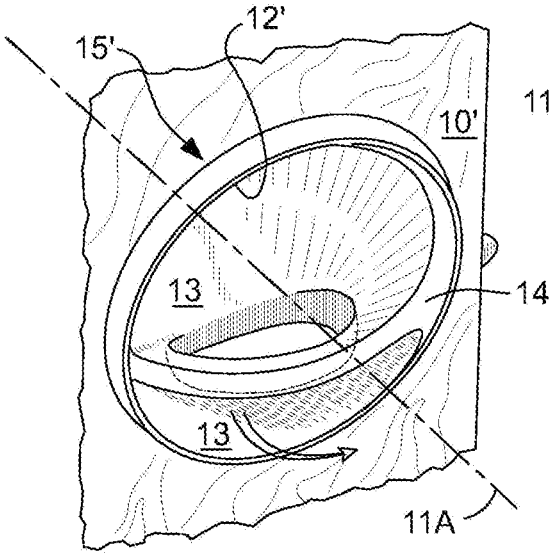
FIG. 3A, is an oblique pictorial view favoring the upper-left aspect of my circular asymmetrical anti-ligative I-shaped fin-lever doorknob and its cooperative escutcheon-plate surround, which functions as a quasi lever-type door-handle.
Figure 3B:
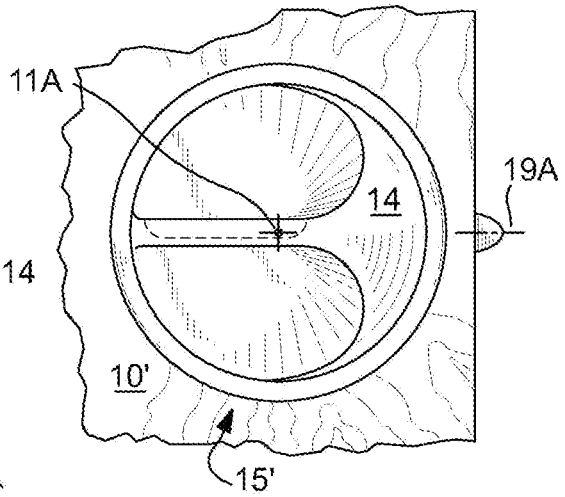
FIG. 3B, is a frontal elevation-view thereof.
Figure 3C:
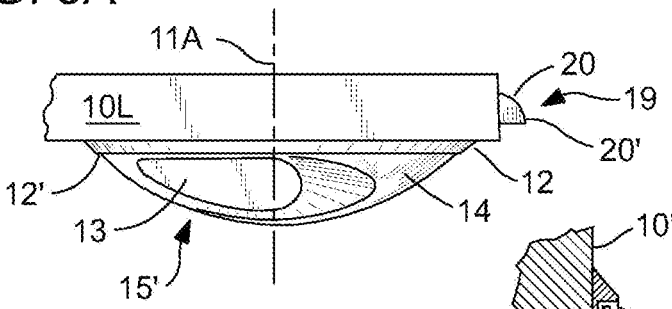
Figure 4A:
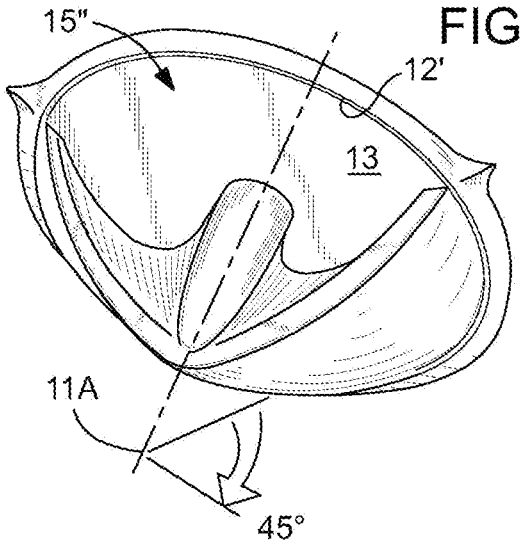
Figure 4B:
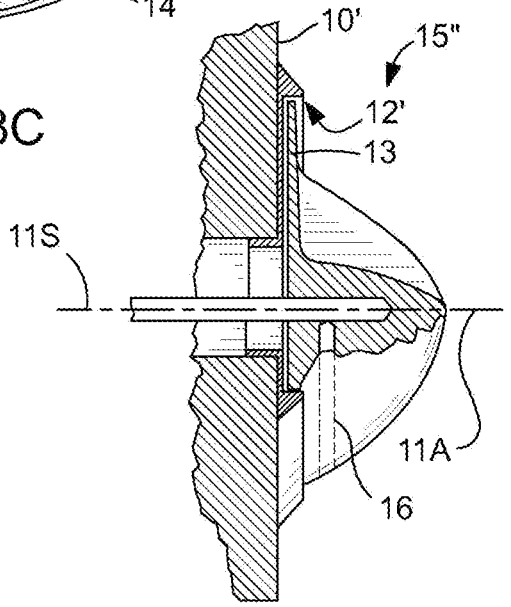
Figure 6A:
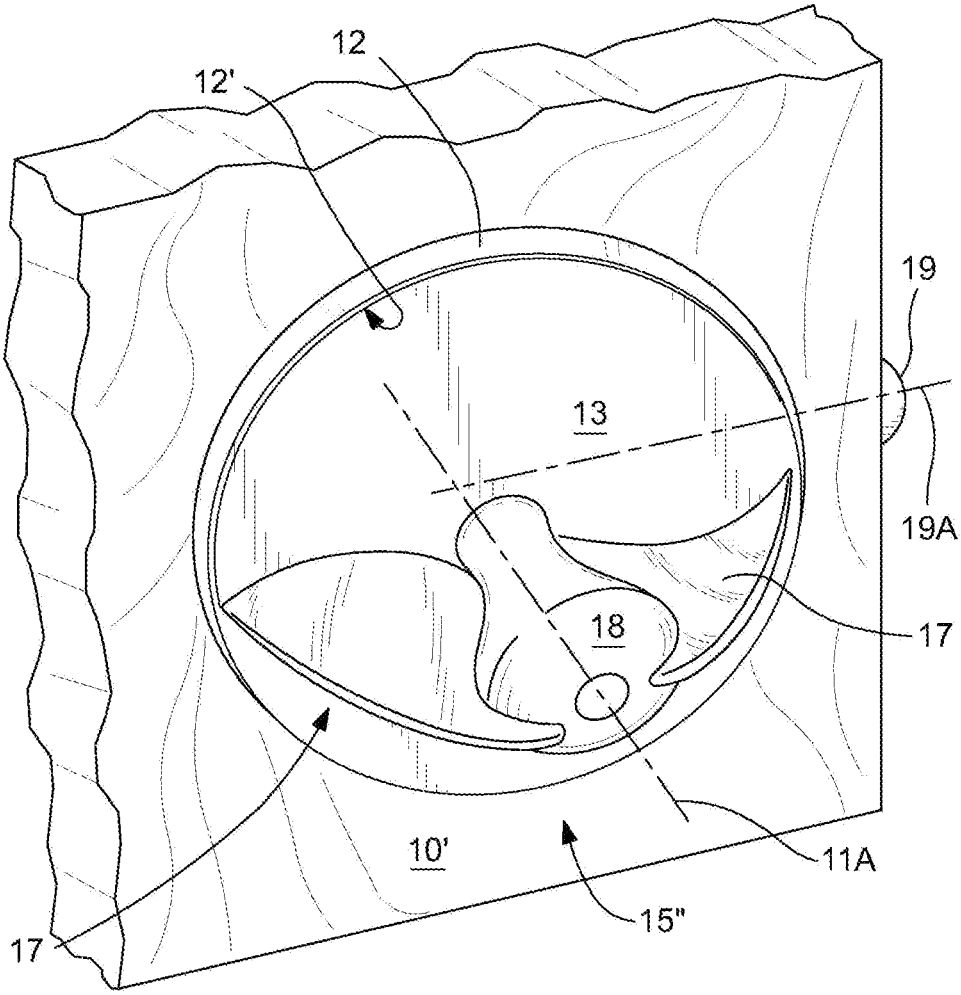
Figure 6B:
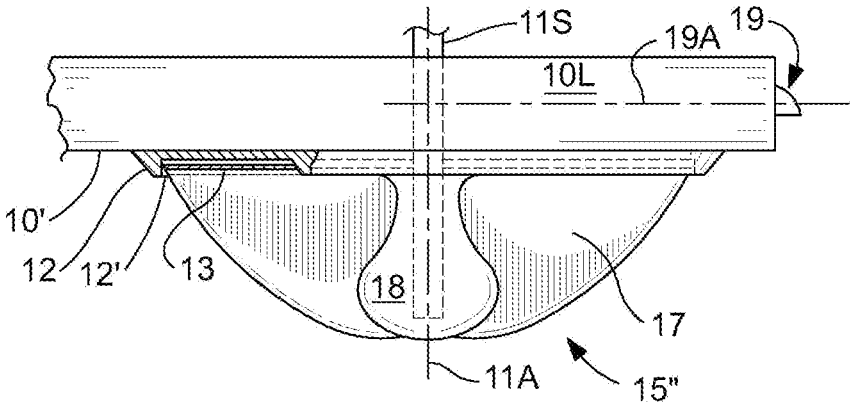
Figure 7A:
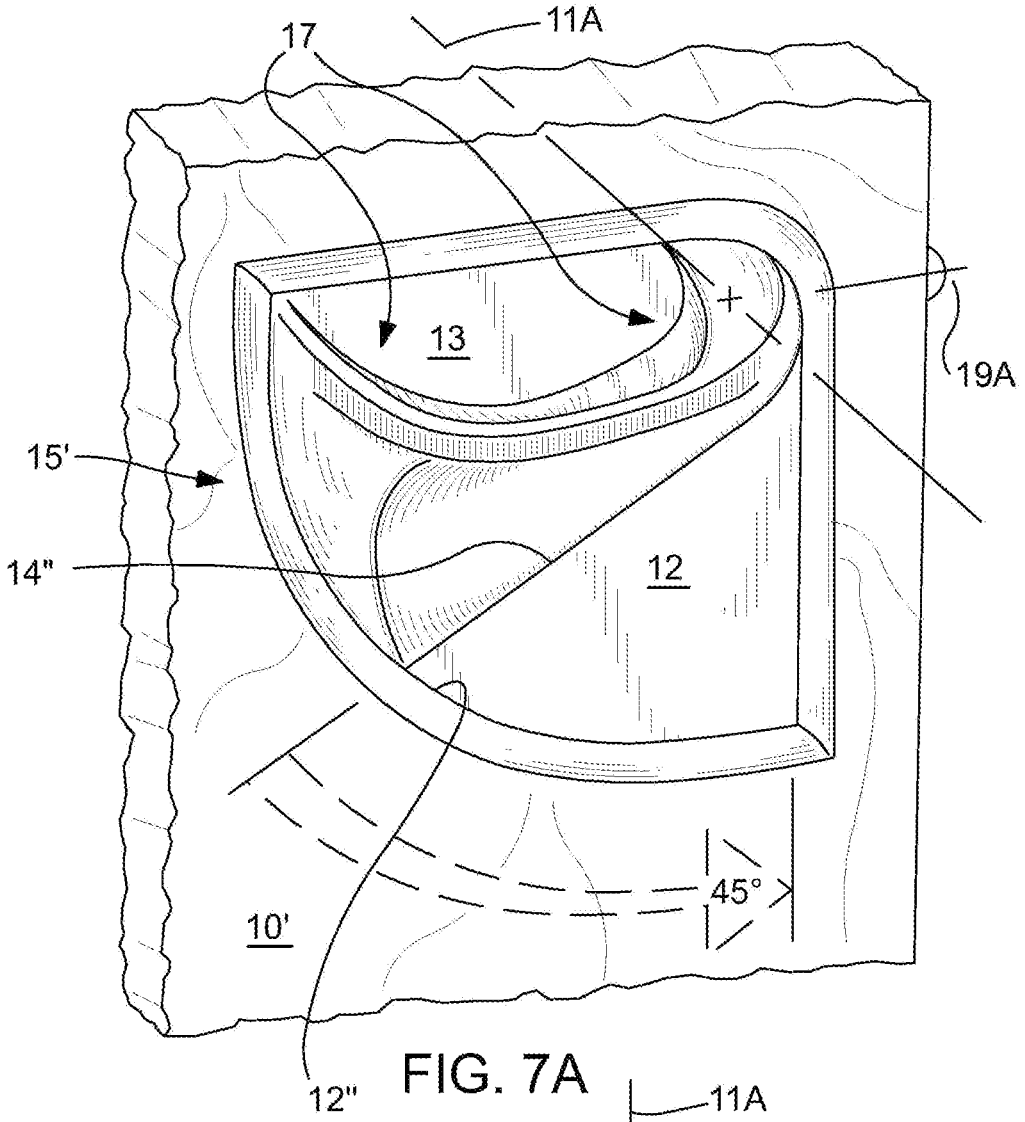
Figure 7B:
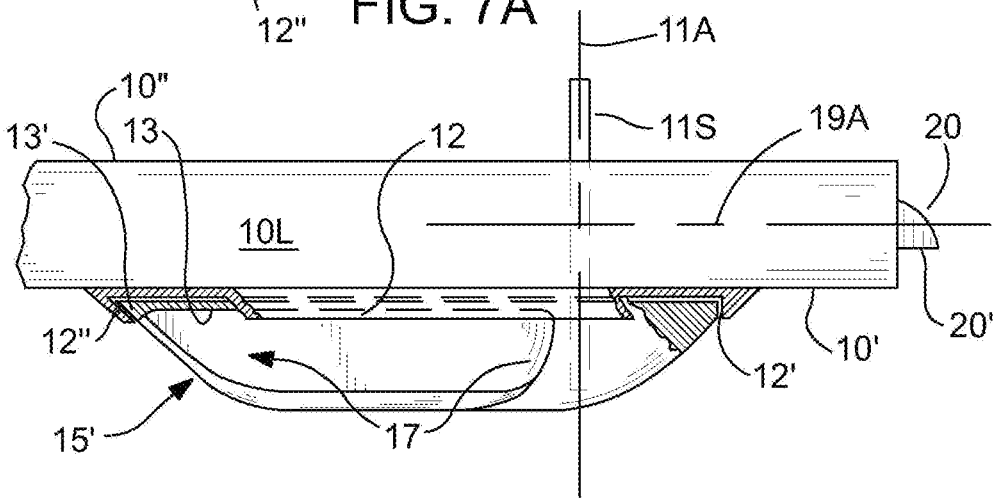
Figure 7C:
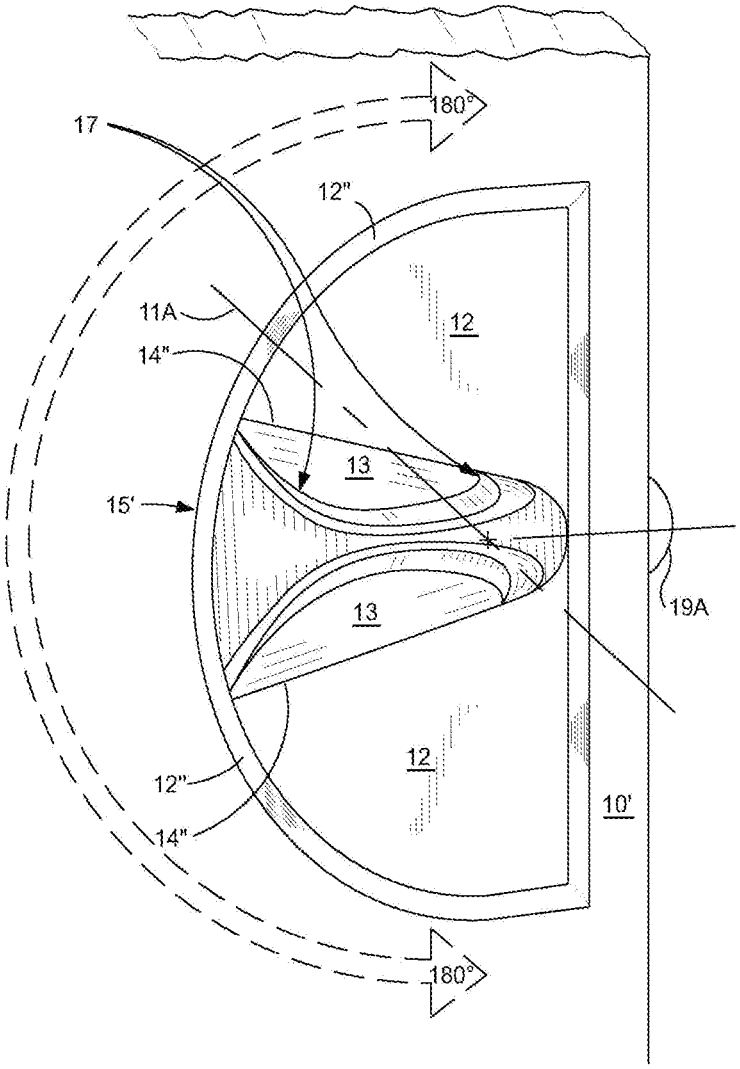

FIG. 3*c*, is an upper plan-view thereof;

FIG. 4A, is an oblique perspective view favoring the upper-right portion of my exemplified V-shaped fin-lever doorknob iteration;

FIG. 4B, is a left/side-elevation cross-sectional view revealing my enshrouding annular-recess typically employed between the fixed escutcheon-plate and the inset rotary backing-plate portion of my doorknobs;

FIG. 5, is an oblique pictorial-view showing my presently most preferred Y-shaped fin-lever anti-ligative symmetrical doorknob configuration, which here includes an integrated central-knob portion which makes its usage readily intuitive;

FIG. 6A, is an oblique perspective-view favoring the upper-left aspect of my dual-opposed asymmetrically dished fin-lever anti-ligative doorknob embodiment, which includes an integrated grasping-knob;

FIG. 6B, is an upper plan-view thereof;

FIG. 7A, is an oblique perspective-view favoring the upper-left aspect of my generic-variant fin-lever doorknob embodiment, which is adapted to function in only an approximate quadrant sector of the circular version exemplified in FIG. 3A, thereby enabling this configuration to be located substantially closer to the distally outward edge of a door if desired;

FIG. 7B, is an upper plan-view thereof, wherein both the far left and right portions have been cut-away so as to reveal the manner in which the perimeter-edges of the pivoting doorknob are recessed and overlapped by the fixed escutcheon-plate;

FIG. 7C, is a perspective-view favoring the upper left aspect of lever doorknob embodiment, which is adapted to function in a quadrant sector of an approximately 180-degree sweep, thereby enabling a handicapped person the option of rotating in one of two directions to move the latchbolt.

Figure 7D:
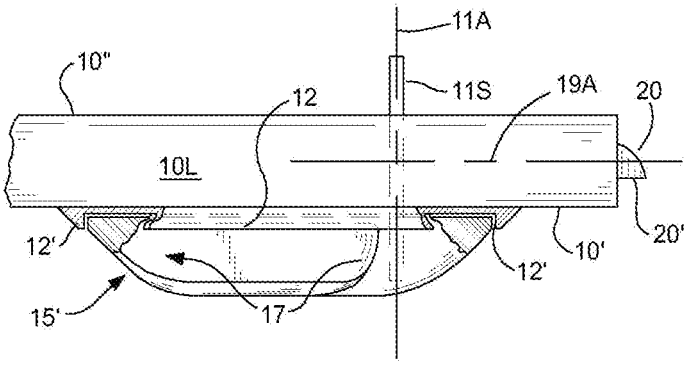

FIG. 7D, is an upper plan view of FIG. 7C, wherein both the far left and right portions have been cut-away so as to reveal the manner in which the perimeter-edges of the pivoting doorknob are recessed into the fixed escutcheon-plate.

Figure 8A:
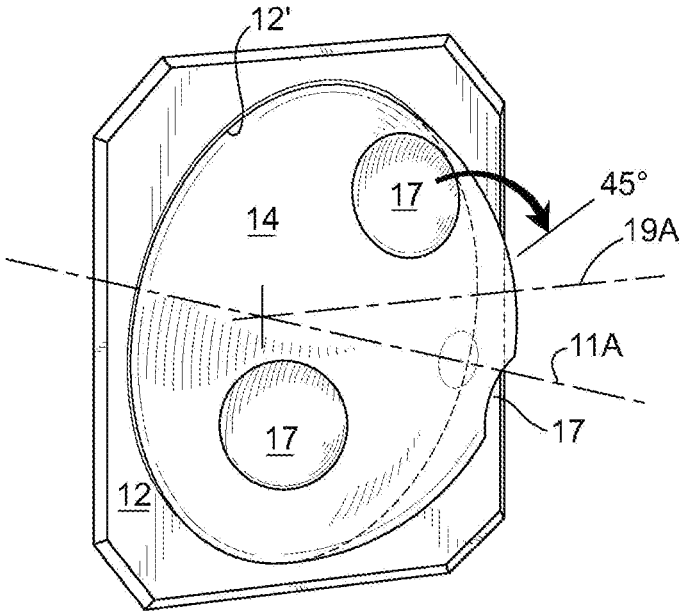
Figure 8B:
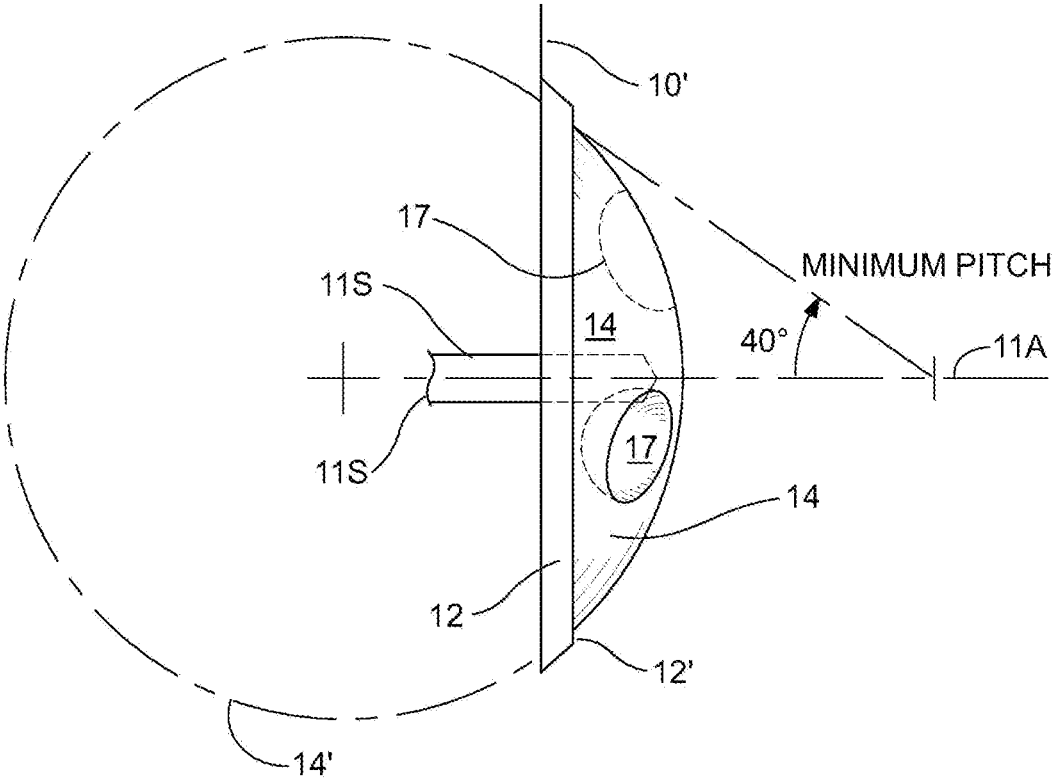

FIG. 8A, is an oblique semi-diagrammatic perspective-view favoring the upper-left aspect of my generic-variant doorknob embodiment, which alternate configuration being remiss of fin-levers, features only an anti-ligative hemispherical auxiliary-surface, thereby further defining the parameters of my disclosure;

FIG. 8B, is a left-side semi-diagrammatic elevation-view thereof, indicating the typical 360-degree critical minimum anti-ligative tangential-angle of 40-degrees relative to the central-axis;

FIG. 9A, is an oblique perspective view favoring the upper-left aspect of my tri-beveled latchbolt sub-assembly, wherein only the outboard anti-ligative terminus portion of the latchbolt is non-conventional;

FIG. 9B, is an upper plan-view thereof;

FIG. 9C, is a side elevation-view thereof;

FIG. 9D, is an end elevation-view thereof.

IV. ITEMIZED NOMENCLATURE REFERENCES

10'/10", 10, 10L, 10H—door-surface: front/rear, door-hinges, upper-ledge, through-hole

11, 11', 11", 11S, 11A, 11L—knob, shaft, bezel, rotary-shank, central-axis, existing latchbolt

12, 12', 12", 12F—escutcheon-plate, annular-recess, undercut, conventional fasteners

13, 13'—backing-plate, retention-flange

14, 14', 14"—auxiliary anti-ligative surface, ref.-sphere, triangular pivot-stop

15', 15", 15Y, 15X—Fin-levered doorknobs: I-shaped, V-shaped, Y-shaped, X-shaped 16—doorknob set-screw

17, 17'—dished finger-hold, anti-ligative fall-line

18—integral grasping-knob

19, 19',19", 19H, 19A—latchbolt, mounting-plate, plate-screws, latchbolt-hole, latchbolt-axis

20/20'/20",20T,20E—latchbolt: in-turn/down-turn/up-turn, outer-terminus, transition-edge

21/21'/21"—exemplified hanging-cord, anchored-end, slip-noose

22—exemplified expired human 'John/Jane Doe'

23—nite-table

V. DETAILED DESCRIPTION OF THE PREFERRED EMBODIMENTS

Figure 1:
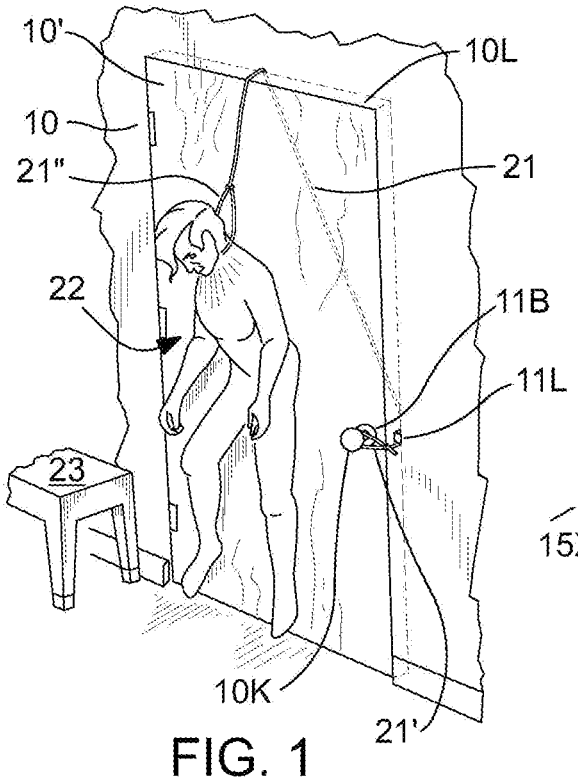
FIG. 1, is a semi-diagrammatic pictorial perspective-view of the 'prior-art', favoring the inside upper-right portion of an ordinary door and door-jamb, whereto is employed a conventional door-knob;—wherein is dramatically exemplified how a distraught person can resort to stringing a self-hanging ligative cording-noose.

Initial reference is given by way of FIG. 1, wherein is exhibited an exemplified suicide scenario wherein the exemplified 'John or Jane Doe' person 22 is shown having willfully executed their demise, as by initially drawing a night-table 23 immediately adjacent a door 10, such as may be typical of a psychiatric institution or hospital for example, where the patient has been typically placed for professional care. Using something such as Dacron® or Nylon® cordage resourcefully pulled from a bed-mattress for example, this extremely distraught exemplified individual 22 had devised a hanging-noose by initially tying 21' a cord 21 around the conventionally protruding door-knob 11, or even around the radial-ledge of the knob's adjoining bezel 11". They then strung the cord beneath the conventional non-receding door-latch 11L, and up the outside of the door and over upper-ledge 10L of the door and down, whereby they had contrived a slip-noose 21" around their neck,—whereupon they stepped-off the existing nite-table 23 and essentially choked themself to death. While there are numerous known variations of this exemplified is contrivance, such as a person of smaller stature even merely hanging a noose from the door knob 11 while in a laid-back near seated position;—it is Indeed a most grievous scenario, but unfortunately all too common of a tragic occurrence, which my special LIFESTAR™ doorknob serves to alleviate.

Figure 2A:
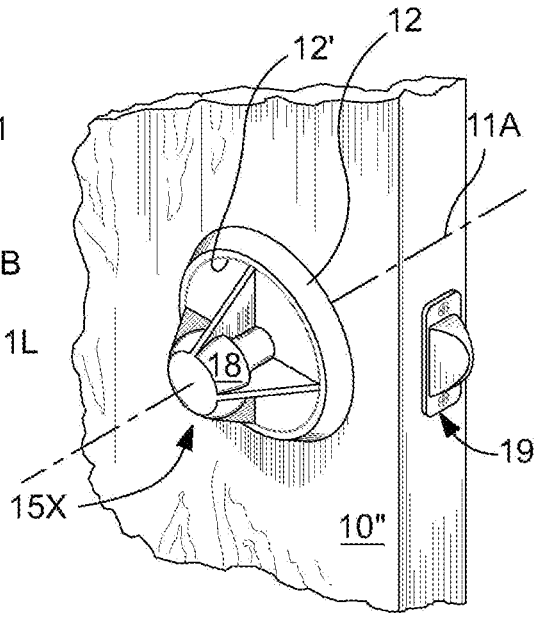
FIG. 2A, is a closer pictorial perspective-view according to that of FIG. 1, wherein has been substituted my X-shaped anti-ligative doorknob and tri-beveled latchbolt apparatus, thereby enabling direct visual comparison, demonstrating how my novel configuration is adapted to defeat such contrived ensnarement which could facilitate a self-hanging cording-noose as exemplified in FIG. 1.

Reference to FIG. 2A shows my LIFESTAR™ anti-ligative doorknob, which is designed to defeat such attempts at ensnaring of the door hardware, owing my novel X-shaped 15X fin-lever configuration, wherein the four radial fin-lever elements serve to effectively defray ensnarement by any sort of devised cording, by causing the cord to merely override potentially ensnarable protruding portions such as the here integrated grasping-knob 18. The principle of its function is somewhat similar in concept to the principle employed during the aerial conflict of WW-II, when the cables tied to explosive Barrage-balloons intended to ensnare attacking aircraft, were instead overridden by means of a V-shaped railing arranged from the nose of a 2-engine attack plane out to its wing-tips; —thereby deflecting the cable off to one side passed the whirling propellers. Therefore it can be readily understood that had my exemplified LIFESTAR™ anti-ligative doorknob 15X and cooperative escutcheon-plate 12, in combination with special anti-ligative latchbolt 19 of FIG. 2A, been installed upon the door in FIG. 1, our exemplified John Doe 22 would have been perhaps somewhat further frustrated, albeit nevertheless alive;—as he would have been unable to find a way to anchor the fatal ligation-noose, as was enabled by both the conventional door-knob 10K and its cooperative latchbolt 16.

Figure 2B:
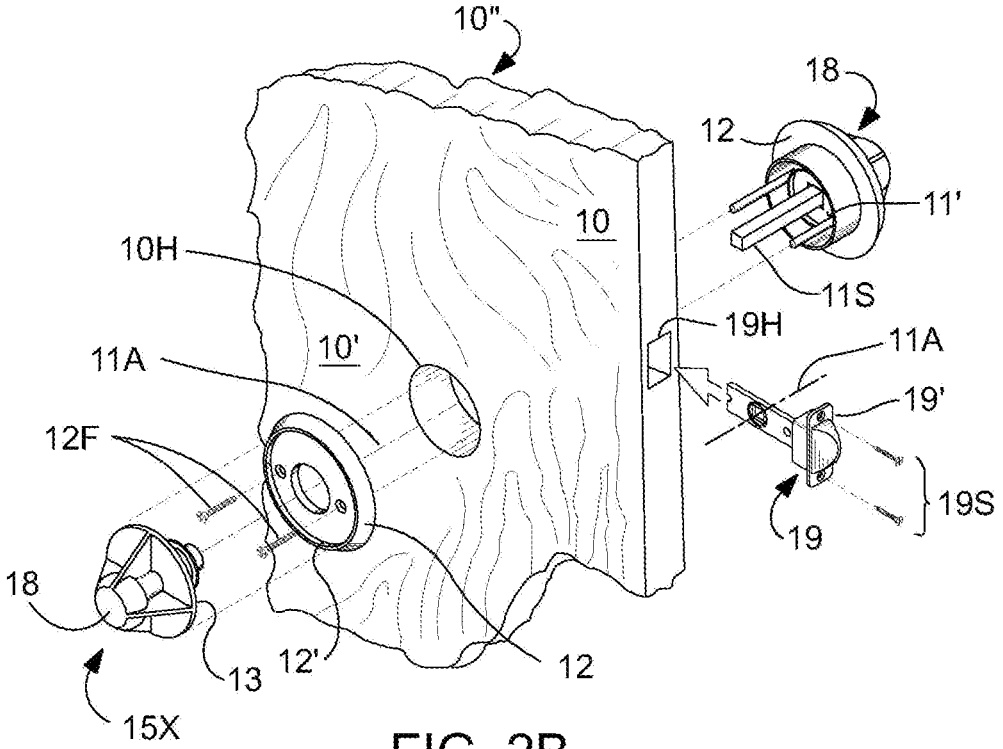
FIG. 2B, is an exploded view thereof, revealing the general basic components of my X-shaped anti-ligative doorknob and cooperative tri-beveled latchbolt combination which were shown installed in FIG. 2A.

Companion FIG. 2B shows the same exemplified quad-finned X-shaped 15X anti-ligative doorknob embodiment disassembled, thereby revealing the door to be entirely conventional, including a conventional existing through-hole 11H, latchbolt-hole 19H, and attendant mounting-plate 19' with usual pair of plate-screws 19". My escutcheon-plate 12 can be adapted with any desired outer perimeter ornamental design, such as the shown circular shape in FIG. 2B, or can be squarish as shown in FIG. 8A for example, or can be oval, diamond shaped, and with various surface textures as may be desired,—in so long as there are no ensnarable declivities nor protrusions of any sort which violate my critical 40-degree slope or pitch criteria; whilst the escutcheon-plate is generally secured via fasteners 12F prior to slip-fitting installation of the doorknob's backing-plate 13 portion,—which is usually secured via a set-screw 16 tightly impinging upon rotary-shank 11S. The thickness of my fin-levers is of no particular specification here, other than they not be so thin as to be fragile or pose a potential injury in the manner of a knife-edge;—thus my individual fin-levers would generally be approximately ⅛th-inch to ⅝-inch in thickness, and preferably with rounded leading-edge formed smoothly with no potential ensnarement declivities. Moreover, none of my fin-lever elements can employ any manner of through-hole which would enable a person to pass a wire, cord, or hook there through.

There remain subtle, however vital other differences which are to become herein more evident and understood as important improvements. For example, FIGS. 3A/B/C show how my anti-ligative doorknob can also be adapted in the form of a single I-shaped preferably horizontally oriented fin-lever iteration 15', which fin-lever can extend across the approximate full diameter of the doorknob's backing-plate 13 (ref. FIG. 2B shows the backing-plate in support of the fin-lever elements), or may employ an auxiliary anti-ligative surface 14 according to engineering design preference. While such a mono-finned embodiment as exhibited in FIG. 3A would likely be considered more of an avant-garde high-style version for homes and up-scale offices (—as compared to my I-shaped fin-lever embodiment of FIGS. 7A/7B which is more suited to institutional or office-building applications);—it however serves to demonstrate the scope of just how my anti-ligative principle can be adapted to door-hardware in general, beyond the pure institutional function of the basic configuration I have presented in FIG. 2A and FIG. 5 for example. Accordingly, my dual-finned or optionally V-shaped 15" embodiment of FIGS. 4A 4B, and my most preferred Y-shaped 15Y embodiment of FIG. 5, as well as my finless embodiment of FIGS. 6A 6B,—all serve to reveal how my anti-ligation principle may be adapted in different ways which appear quite diverse, yet they all embody a common novel function of providing an integral overriding shape or profile, in combination with an escutcheon-plate 12 employing a vital anti-ligative annular-recess 12' provision such as is revealed in the exploded-view of FIG. 2B and cutaway-view of FIG. 4B, which show how the usually circular backing-plate 13 of my doorknobs, is inset relative to an enshrouding escutcheon-plate 12, thereby serving to functionally deflect attempts at ensnaring a cord, by deflecting the cord outwardly away from endeavored ensnarement behind the doorknob, and thereby preventing the situation exhibited in FIG. 1. Accordingly, to fully appreciate the function of my fin-levers, one must understand that in my FIG. 5 tri-finned embodiment for example,—if a cord were extended horizontally across between the afterward portion of the upper two fin-lever elements of the Y-shape, it would appear viewing from a front/elevation-view aspect that ensnarement of the cord is attained;—however, I have discovered via exhaustive tests that when viewed from an upper/plan-view aspect, one finds that instead of hanging-up, the arch of the respective left and right fin-levers comes into play, whereby downward pull of the cord ends actually urges the cord to automatically slide outward upon the arch of the fin-levers, until it thereby simply falls entirely free from my elusive non-ensnarable doorknob assembly!

Study of FIGS. 6A/6B shows my dual-opposed fin-lever doorknob 15" embodiment, which in this example are arranged in an optional horizontal asymmetric slightly S-shaped configuration; whereby the left fin-lever portion is preferably formed with a concave dished 17 under-surface, while the right fin-lever portion is shown preferably formed with a concave dished 17 upper-surface. This aesthetic almost leaf like embodiment also employs a centrally integrated grasping-knob 18 member,—thereby providing a very intuitively operated human-engineering quality;—yet which laterally extending fin-levers very effectively serve to ward off attempt at ensnarement around the central grasping-knob 18. The notion of my central grasping-knob 18 is to provide easily confused persons with a visually familiar knob entity,—which thereby becomes cognitively intuitive to most any user in its operation.

In FIGS. 7A/7B is shown a further evolution of my anti-ligative doorknob, the escutcheon-plate 12 embodied here as an alternate 90-degree quadrant iteration of my usual full 360-degree embodiments,—wherein the cooperative fin-lever 15' is slightly modified as to suit installations where a conventional ensnarable L-style doorknob is specified;—yet my smoothly integrated configuration virtually eliminates the problematical ensnarement points of the conventional L-shaped door-knob design. Another important advantage of my exemplified FIG. 7A fin-lever doorknob 15' and quadrant escutcheon-plate 12 embodiment, resides in its ability to be mounted close to the door edge (approx. 2½-inches), without having to compromisingly reduce the horizontal breadth of the overall escutcheon-plate 12, or otherwise resort to additional offsetting mechanism of some sort in order to utilize the original through-hole 10H (ref. FIG. 2B). Additionally, my human-engineered dished left and right surface areas 17 enable a handicapped person having no hands for example, to readily employ their stub-wrist into the slight carved-in pocket like formation near the central-axis 11A while using their forearm to depress the left portion of the actuator toward the 45-degree rotational point indicated in FIG. 7A. Note also in FIG. 7A how this exemplified fin-lever 15' includes an optional lower triangular pivot-stop 14" appendage, which serves as an approximate 45-degree pivot-stop device; while the left distal-end of fin-lever 15' preferably includes a positively engaged retention-flange 13'.

The companion illustration of FIG. 7B includes cutaway portions at the left and right, serving to reveal how the doorknob actuator is installed by first captively inserting the retention-flange 13' portion of the actuator into the quadrant-style escutcheon-plate's perimeter undercut 12" annular-recess groove 12', followed by seating the opposite semi-circular portion within the enshrouding non-ensnarable annular-recess 12' at the upper-right portion of the quadrant-type escutcheon-plate 12. Provision of the retention-flange 13' serves to effectively thwart any attempt to pry the fin-lever outward from the escutcheon-plate so as to ensnare a cord behind it. In lieu of providing this retention-flange 13', the annular-recess inset must be made substantially deeper (i.e. such as minimum of ⅜-inch) as compared to my doorknobs having a fully stabilized circular backing-plate 13' shown in my FIG. 6B embodiment for example. Importantly, it should also be understood that my usage of the term approximate 'quadrant' type escutcheon-plate, is to thereby broadly also include general inference to semi-circular escutcheon-plate shapes which may be substantially less than a pure 90-degree quadrant (i.e. such as only approximately 45-degrees for example), yet also not to exceed a so-called quadrant sector of an approximate 180-degree sweep;—so as to in any case thereby enable the doorknob central-axis to be located significantly closer to the outermost distal-edge of the door than would a full 360-degree circular type escutcheon-plate for example.

The embodiment of FIG. 8B serves to demonstrate that my anti-ligative principle is essentially dependent upon all my finned and non-finned doorknobs being typically configured within a minimum 40-degree pitch of 'profile sight' (i.e. this critical anti-ligative pitch-angle may also be interpreted as a maximum of 50-degrees if measured relative to the face of the door), whereby it has been found that with this 'fall-line' 17' being formed remiss of cord ensnarable declivity, be it achieved via means of single or plural radial finnage, or via substantially equivalent hemispherical anti-ligative auxiliary surface 14'. While some of my anti-ligative doorknobs may employ a dished finger-hold 17 provision, such as are exemplified in FIGS. 3A/3B/3C, FIG. 4A/4B, FIGS. 6A/6B; none of these constitute sufficient a declivity as to enable a person to resourcefully devise a positive ensnarement thereto.

Reference to FIGS. 9/A/B/C/D presents my cooperative anti-ligative door latchbolt 19 device, which employs a novel triad outer terminus comprised of a latch portion having the usual beveled striker surface 20 in unique combination with a down-turned (flat or arched) 20' upper surface portion, and an up-turned (flat or arched) 20" lower surface portion. These three adjoining latch surfaces thus converge outboard proximal outer-terminus 20T, thereby allowing the latchbolt to operate substantially as a conventional door-latch under normal circumstances;—with the exception that unlike a conventionally square-cut latch 11L in FIG. 1, my latchbolt 19 will be caused to merely readily recede fully into the mounting-plate 19' against the conventional latch-mechanism return-spring (reference black action-arrow in FIG. 9B) if attempt is made to ensnare the triad with a cord 21 as exemplified in FIGS. 9A and 9D;—thereby defeating any attempt to capture the latch 11L as was demonstrated by John Doe in FIG. 1. Therefore as shown in FIG. 9D, my triad-beveled latchbolt thus in principle employs substantially the same critical 40-degree anti-ligative 'fall line' 17' principle as my exemplified doorknobs 15'/15"/15Y/15X;—thereby similarly preventing ensnarement via any sort of cording from either an upward or downward direction. While I have generally shown the outboard portion of my latchbolt to be somewhat chisel-edged, in actuality the three surfaces may be flat-surfaced, multi-facetted, or conversely converge in a very rounded manner as to the exemplified transition-edge 20E;—thereby in effect presenting an optional smoothly semi-hemispherical bullet-tip appearance as shown in FIG. 2A, wherein there are no necessarily sharply defined transition-edges 20E (as shown in FIG. 9C), and thus only the portion of the latchbolt facing the hinged side of the door 10" preferably remains substantially flat and vertical in the manner of a conventional door-latch. Again, the critically essential criteria being that in order to induce reliable/predictable slippage of an ensnaring-cord, the upper and lower impingable surfaces of the latchbolt must employ my discovered critical minimum 40-degree anti-ligative principle.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed is:

1. An anti-ligative ergonomic doorknob system for a hinge-mounted door, said system comprising:

a lever having a sloped outer surface and a rotary-shank connected to one end of the lever, the rotary shank configured to move a latchbolt between latched and unlatched positions;

a backing plate extending from the lever;

an escutcheon-plate on which the lever and backing plate are disposed; and a recess or groove forming a partial-circle in the escutcheon-plate and retaining an end of the lever or backing plate opposite the rotary shank as the lever rotates to prevent ensnarement of a cord under the lever or backing plate;

the sloped outer surface of the lever configured to prevent frictional ensnarement of the cord when placed on or around the doorknob or in a configuration that uses an upper surface, side surface, or bottom surface of the door in conjunction with the doorknob.

2. The anti-ligative doorknob system of claim 1, wherein the fixed escutcheon-plate forms a partial circle of approximately 45-degrees to 180-degrees sector of a circle.

3. The anti-ligative doorknob system of claim 1, wherein the lever has a minimum 40-degree radial sloped outer surface as measured tangentially relative to a central axis of the rotary-shank.

4. The anti-ligative doorknob system of claim 1, further comprising:

a retention-flange extending from the backing plate; and the recess or groove forming a guide in the escutcheon-plate serving to positively retain the retention-flange within said escutcheon-plate as the lever rotates.

5. The anti-ligative doorknob system of claim 1, the lever further including a dished surface area to enable a person having no hands to operate the doorknob system.

6. The anti-ligative doorknob system of claim 1, the lever further including a pivot-stop to limit rotation of the lever.

7. The anti-ligative doorknob system of claim 1, wherein the lever further includes a dished surface.

8. The anti-ligative doorknob system of claim 1, wherein the lever further includes a pivot-stop to limit rotation of the lever.

9. An anti-ligative ergonomic doorknob system for a hinge-mounted door, said system comprising:

a lever having a rotary-shank connected to one end of the lever, the rotary shank configured to move a latchbolt between latched and unlatched positions, the lever having a distal end opposite the rotary-shank and a sloped outer surface between the rotary shank and the distal end;

a backing plate extending from the lever between the rotary shank and the lever distal end, the backing plate having an edge forming a retention-flange distal from the rotary-shank; and an escutcheon-plate on which the lever and backing plate are disposed for rotation about the rotary shank, the escutcheon plate having an edge receiving the backing plate retention-flange to prevent ensnarement of a cord under the backing plate or lever;

the sloped outer surface of the lever configured to prevent frictional ensnarement of the cord when placed on or around the doorknob or in a configuration that uses an upper surface, side surface, or bottom surface of the door in conjunction with the doorknob.

10. The anti-ligative doorknob system of claim 9, wherein the lever and backing plate rotate in an approximately 45-degrees to 90-degrees sector about the rotary shank.

11. The anti-ligative doorknob system of claim 9, wherein the lever has a minimum 40-degree radial sloped outer surface as measured tangentially relative to a central axis of the rotary-shank.

12. The anti-ligative doorknob system of claim 9, wherein the retention-flange is retained below the edge of the escutcheon-plate as the lever rotates.

13. An anti-ligative ergonomic doorknob system for a hinge-mounted door, said system comprising:

a fixed escutcheon-plate having a surface and a recess or groove forming a partial-circle; and a lever having a rotary-shank connected to one end of the lever, the rotary shank configured to move a latchbolt between latched and unlatched positions, the lever being sufficiently close to the escutcheon-plate surface to prevent ensnarement of a cord under the lever and having another end opposite the rotary shank retained in the recess or groove in the escutcheon-plate during rotational movement of the lever about the rotary shank to prevent ensnarement of the cord under the lever, the lever further having a sloped outer surface configured to prevent frictional ensnarement of the cord when placed on or around the doorknob or in a configuration that uses an upper surface, side surface, or bottom surface of the door in conjunction with the doorknob.

14. The anti-ligative doorknob system of claim 13, wherein the fixed escutcheon-plate recess or groove forms a partial circle of less than a 90-degree sector of a circle.

15. The anti-ligative doorknob system of claim 13, wherein the lever has a minimum 40-degree radial sloped outer surface as measured tangentially relative to a central axis of the rotary-shank.

16. The anti-ligative doorknob system of claim 13, wherein the lever further includes a dished surface area.

17. The anti-ligative doorknob system of claim 13, wherein the lever further includes a pivot-stop to limit rotation of the lever.

18. An anti-ligative ergonomic doorknob system for a hinge-mounted door, said system comprising:

a lever having a sloped outer surface and a rotary-shank connected to one end of the lever, the rotary shank configured to move a latchbolt between latched and unlatched positions;

a backing plate extending from the lever;

an escutcheon-plate on which the lever and backing plate are disposed; and a recess forming a partial-circle in the escutcheon-plate and retaining an end of the lever or backing plate opposite the rotary shank as the lever rotates to prevent ensnarement of a cord under the lever or backing plate;

the sloped outer surface of the lever configured to prevent frictional ensnarement of the cord when placed on or around the doorknob or in a configuration that uses an upper surface, side surface, or bottom surface of the door in conjunction with the doorknob.

19. The anti-ligative doorknob system of claim 18, further comprising:

a retention-flange extending from the backing plate; and the recess forming a guide in the escutcheon-plate serving to positively retain the retention-flange within said escutcheon-plate as the lever rotates.

20. An anti-ligative ergonomic doorknob system for a hinge-mounted door, said system comprising:

a lever having a sloped outer surface and a rotary-shank connected to one end of the lever, the rotary shank configured to move a latchbolt between latched and unlatched positions;

a backing plate extending from the lever;

an escutcheon-plate on which the lever and backing plate are disposed; and a groove forming a partial-circle in the escutcheon-plate and retaining an end of the lever or backing plate opposite the rotary shank as the lever rotates to prevent ensnarement of a cord under the lever or backing plate;

the sloped outer surface of the lever configured to prevent frictional ensnarement of the cord when placed on or around the doorknob or in a configuration that uses an upper surface, side surface, or bottom surface of the door in conjunction with the doorknob.

21. The anti-ligative doorknob system of claim 20, further comprising:

a retention-flange extending from the backing plate; and the groove forming a guide in the escutcheon-plate serving to positively retain the retention-flange within said escutcheon-plate as the lever rotates.

22. An anti-ligative ergonomic doorknob system for a hinge-mounted door, said system comprising:

a fixed escutcheon-plate having a surface and a recess forming a partial-circle; and a lever having a rotary-shank connected to one end of the lever, the rotary shank configured to move a latchbolt between latched and unlatched positions, the lever being sufficiently close to the escutcheon-plate surface to prevent ensnarement of a cord under the lever and having another end opposite the rotary shank retained in the recess in the escutcheon-plate during rotational movement of the lever about the rotary shank to prevent ensnarement of the cord under the lever, the lever further having a sloped outer surface configured to prevent frictional ensnarement of the cord when placed on or around the doorknob or in a configuration that uses an upper surface, side surface, or bottom surface of the door in conjunction with the doorknob.

23. An anti-ligative ergonomic doorknob system for a hinge-mounted door, said system comprising:

a fixed escutcheon-plate having a surface and a groove forming a partial-circle; and a lever having a rotary-shank connected to one end of the lever, the rotary shank configured to move a latchbolt between latched and unlatched positions, the lever being sufficiently close to the escutcheon-plate surface to prevent ensnarement of a cord under the lever and having another end opposite the rotary shank retained in the groove in the escutcheon-plate during rotational movement of the lever about the rotary shank to prevent ensnarement of the cord under the lever, the lever further having a sloped outer surface configured to prevent frictional ensnarement of the cord when placed on or around the doorknob or in a configuration that uses an upper surface, side surface, or bottom surface of the door in conjunction with the doorknob.

* * * * *